United States Patent [19]

Stäheli et al.

[11] Patent Number: 4,940,367

[45] Date of Patent: Jul. 10, 1990

[54] PNEUMATIC FLOCK FEED SYSTEM FOR SUPPLYING MULTIPLE CARDS AND/OR STAPLE CARTING MACHINES

[75] Inventors: Christoph Stäheli, Frauenfeld; Urs Staehli, Turbenthal, both of Switzerland

[73] Assignee: Rieter Machine Works, Ltd., Winterthur, Switzerland

[21] Appl. No.: 228,529

[22] Filed: Aug. 4, 1988

[30] Foreign Application Priority Data

Aug. 12, 1987 [CH] Switzerland ..... 03109/87

[51] Int. Cl.[5] ..... B65G 53/66

[52] U.S. Cl. ..... 406/30; 19/105; 406/14; 406/156

[58] Field of Search ..... 19/105; 406/14, 29, 406/30, 155, 156

[56] References Cited

U.S. PATENT DOCUMENTS 4,353,667 10/1982 Mandl et al. ..... 406/30
4,530,134 7/1985 Hösel ..... 19/105
4,535,511 8/1985 Leifeld et al. ..... 19/105
4,701,981 10/1987 Leifeld ..... 406/156
4,723,344 2/1988 Leifeld ..... 19/105
4,779,311 10/1988 Leifeld ..... 19/105

*Primary Examiner*—Sherman D. Basinger
*Assistant Examiner*—Anne Sartelle
*Attorney, Agent, or Firm*—Kenyon & Kenyon

[57] ABSTRACT

The fiber processing plant has a pneumatic flock feed system which is operated in dependence on an operating parameter which, in turn, is dependent upon the number of fiber processing machines which are operating at a given time. In one embodiment, a meter is disposed in a feed duct of the flock feed system between a fan and a first of the fiber processing machines in order to sense the static pressure therein. The meter is used to sense a difference in pressure caused by one or more fiber processing machines becoming inoperative so as to cause a switching on or off of the fiber supply to the feed duct.

24 Claims, 4 Drawing Sheets

PNEUMATIC FLOCK FEED SYSTEM FOR SUPPLYING MULTIPLE CARDS AND/OR STAPLE CARTING MACHINES

This invention relates to a fiber processing plant. More particularly, this invention relates to the feeding of fiber flocks to textile machines particularly, cards and staple carding machines.

As is known, pneumatic installations for feeding fiber flocks to a number of cards in a spinning mill have been in practical use for more than 25 years. In some cases, the installations have used air circulation systems for conveying the fiber flocks, while, in more recent times, installations without circulation of conveying air or excess flocks have come into use. A system for controlling a feed machine for supplying fiber flocks in a conveying system of the aforementioned kind is described in DE No. 1 971 420 and, more exhaustively, in the Corresponding U.S. Pat. No. 3,414,330. In this system, the feed machine is controlled in accordance with the static pressure in the conveying system. The feed machine can either be switched on and off (stop-go operation) or can be continuously adapted to changing conditions in the conveying system (U.S. Pat. No. 3,414,330). The operating level of a fan delivering the conveying air can also be adapted to these conditions (U.S. Pat. No. 3,414,330). This principle is also discussed in German PS No. 2 834 586 (U.S. Pat. No. 4,321,732).

Further developments of this principle are described in DOS 3 442 942 which refers to yet earlier known plants, in which the amount of air and/or the air speed are adjusted in dependence on data specific to the batch or on the number of cards in operation. These adjustments, however, are somewhat s expensive since they have to be carried out by replacing V-belt pulleys on the conveying fan and the motor driving the fan.

The fan DOS No. 3 442942 prescribes a method of automatic adaptation of the amount of air or the air speed. In a proposal to this end, a control system directly or indirectly determines the number of cards to be fed and the operating level (Speed of rotation) of the conveying fan is adjusted accordingly. In a variant of this proposal (FIG. 6 of DOS 3 442 942), the control system determines the air pressure in the plant, the amount of air, the air speed and the number of connected cards, and alters the speed of the conveying fan accordingly. The DOS does not discuss the question how the quantities which have been determined are to be processed in the control system. According to a development of the last-mentioned variant, the regulating device controlling the conveying fan co-operates with a regulating device "which regulates the amount of fiber flocks supplied". The DOS contains no further details about this system.

The prior art also includes the proposal published in DOS No. 2 435 677 (and in the corresponding U.S. Pat. No. 4,353,667) according to which the amount of delivered flocks is first determined, e.g. by measuring the static pressure at the fan outlet, and then regulated. The system is not designed to respond to a change in the structure of the plant. According to this proposal, also, the production of the feed machine is continuously varied, though this is not always desirable.

"Production" (more particularly in stop-go operation)

To avoid confusion, some terms used in the description will now be explained in detail:

The "instantaneous production" of a feed machine during stop-go operation is either the (adjustable) maximum production (PM—machine switched on) or zero (machine switched off). During the subsequent description, when the word "production" is used without qualification it refers to the instantaneous set maximum production Pm.

The "effective production" of the fed machine during stop-go operation depends on the set maximum production Pm and on the operative/inoperative time ratio, i.e. if the operative/inoperative time ratio is 9:1, the effective production is 90% of the maximum production Pm.

The (maximum) production can be adjusted by varying the speed of working components of the feed machine. It is known (Aerofeed F plants made by Maschinenfabrik Rieter AG) for the production to be automatically adapted to the number of cards allocated to the feed machine.

The (flock) feed (or supply) during stop-go operation can be regarded as the aforementioned effective production and during normal stop-go operation (with permanently adjusted maximum production Pm) is controlled by varying the operative/inoperative time ratio. Today this is done in dependence on the filling conditions in the chutes of the connected cards, but normally the feed machine control system does not receive any information directly from level sensors in the chute. On the contrary, the control system has to respond to a selected operating parameter (e.g. the static pressure in the feed duct), which represents a "cross-section" of the filling conditions in all the connected chutes.

During continuous operation the instantaneous production of the feed machine can be regulated in dependence on the filling conditions in the chutes.

It is an object of the invention to adapt the control of the supply of flocks to a conveying plant or the instantaneous production of a feed machine to different operating conditions.

Briefly, the invention provides a fiber processing plant which includes a pneumatic conveying system for feeding flocks to a variable number of fiber-processing machines and control means for controlling the amount of flocks conveyed.

The conveying system comprises a feed duct, means for producing an airstream in the duct, and means for supplying flocks thereto. The word "feed duct" here refers to the connection between the connected fiber-processing machines and the flock or air feed means supplying them. Where a tube is connected to two feed machines and comprises separators for determining the allocation to the feed machines, the duct portions from each feed machine to the separator each constitute a "feed duct".

The supply of flocks or the instantaneous production of the feed machine is controlled in dependence on an operating parameter. Preferably, the chosen operating parameter is the static pressure in the feed duct in front of the first fibre-processing machine. Alternatively, other suitable varying parameters can be chosen, e.g., the torque needed for driving a fan or the instantaneous value of the fan drive power, these being mentioned in U.S. Pat. No. 4,353,667 as alternatives to measuring the static pressure. The amount of air may also be chosen as the operating parameter, as mentioned in DOS No. 3 442 942.

The plant is characterized in that the supply of flocks to the duct or the instantaneous production of the feed machine is adjusted to the number of flock-processing machines.

Accordingly the plant can be characterized by the following features:

Means for determining the number of machines to be supplied:

Means for determining a set value for the parameter depending on the number of machines supplied;

A meter which responds to the aforementioned operating parameter, and

An actuator which, in dependence on the relationship between the set value and the actual value recorded by the meter, adjusts the feed of flocks by the supply means or the instantaneous production of a feed machine.

During normal operation the means for generating an air stream are continuously driven, but the air supply can either be controlled or automatically adjusted to the conveying conditions.

When the flock delivery means are in stop-go operation, the means for detecting the set value can define a set range having an upper and a lower limit, so that the delivery means are switched on if the instantaneous value of the parameter reaches one limit of the range, and switched off if the instantaneous value of the parameter reaches the other limit of the range. The set range therefore corresponds to "acceptable" filling conditions in the connected chutes. If one or the other limit is exceeded, this indicates "unacceptable" conditions (too high or too low), requiring a corresponding change in the state (stop or go) of the feed machine.

During a switched-on period the delivery means can operate under predetermined conditions, making it easy to maintain a constant quality in the end product. More particularly the production of the delivery means during the switched-on phase can be determined independently of changes in the aforementioned operating parameter. This "total production" of the delivery means can be determined in dependence on the total number of fiber-processing machines coupled to the feed duct, irrespective of whether all the machines are instantaneously in use. Means for determining the number of machines coupled to a feed duct are already known, e.g., from the aforementioned DOS No. 3 442 942, and in connection with the aforementioned Aerofeed F plants, and can be used for adjusting the total production of the delivery means.

By way of example, a plant according to the invention and variants thereof will now be described in detail with reference to the drawings, in which.

Figure 1:
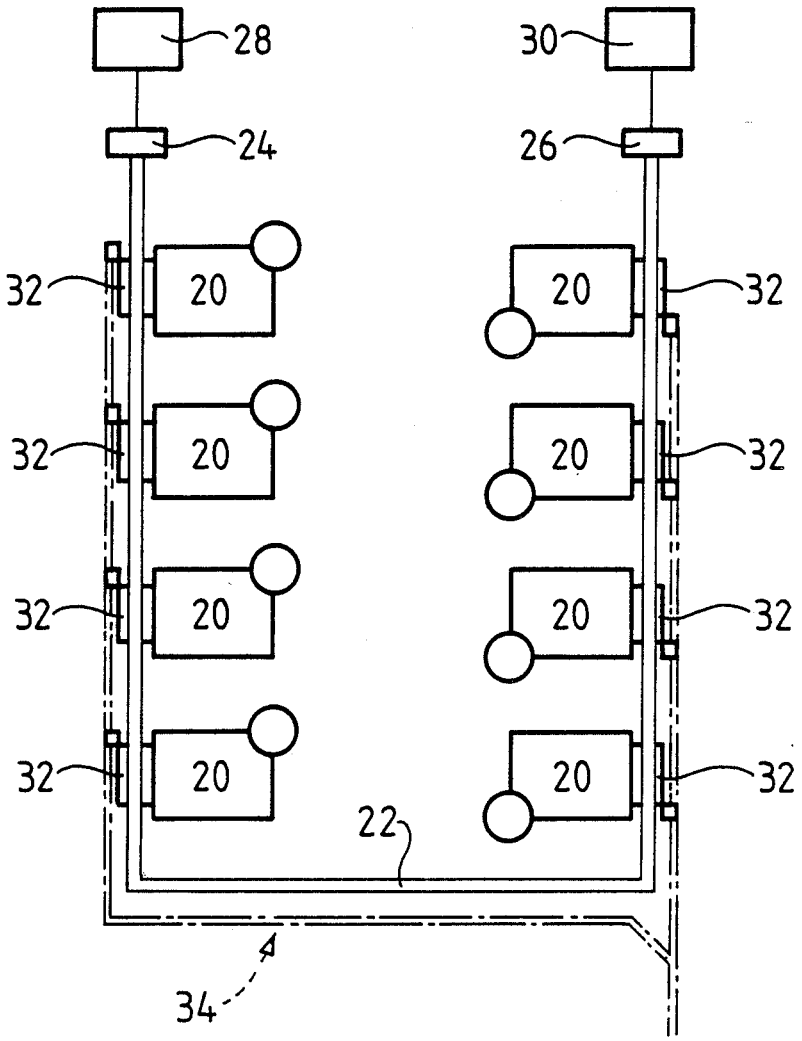
FIG. 1 is a diagrammatic view of the structure of a plant (Aerofeed U plant by Maschinenfabrik Rieter AG) and the corresponding air conditions in the conveying system.

FIG. 1 by way of example shows a plant comprising a "string" of a total of eight cards 20. A common feed duct 22 extends over the cards. In the example shown, the cards are disposed in two rows and the feed channel is therefore U-shaped, but this arrangement is not important as far as the invention is concerned. A fan 24, 26 delivering conveying air is coupled to each end of line 22. Each fan 24, 26 is associated with a respective feed machine 28 or 30 for delivering fiber flocks.

Each card 20 is associated with a respective filling chute 32 which receives flocks from duct 22 and delivers them in the form of a wad to the corresponding card 20. Some of the conveying air flows from duct 22 through various chambers of chute 32 to an exhaust air system shown chain-dotted in FIG. 1 and indicated by reference 34. Since this system does not play a part in the invention, it will not be further described here. The air flow path between duct 22 and the exhaust air system 34 is described in European patent application No. 176668 which description is accordingly included in this application.

FIG. 1 shows a card string which can be separated by suitable separators into two "lines". Suitable separators are described in European patent application 175056 and also in DOS No. 3 442 942, but other suitable separators were used in the aforementioned Aerofeed F plants. After the separators have been suitably adjusted, one line of cards can be operated on flocks from feed machine 28 and the other line on flocks from machine 30, the number of cards per line being adapted to the production conditions in the spinning mill. In the subsequent description of FIGS. 2 and 3, reference is made to only one line, i.e. the line fed with flocks by machine 28. However, the remarks concerning this line apply also to the other line in the total system.

Figure 2:
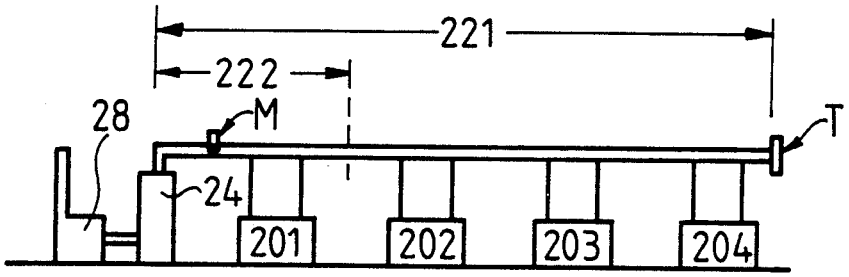
FIG. 2 is a side view of a part of the plant in FIG 1.

In the example shown in FIG. 2 it is assumed that the diagrammatically indicated separator T divides the card string into two lines of four cards each, so that cards 201, 202, 203 and 204 together with the corresponding duct portion 221 are associated with fan 24 and feed machine 28, the line thus defined offers some flow resistance to fan 24, shown in the form of a static pressure which can be measured on a meter M in duct 22 between fan 24 and the first card 201.

If separator T is re-adjusted so that the line is reduced to a single card (i.e. only card 201 and duct portion 222 are allocated to fan 24 and feed machine 28), the newly-defined line offers a different, higher flow resistance to fan 24, shown by an increased static pressure at meter M.

Figure 3:
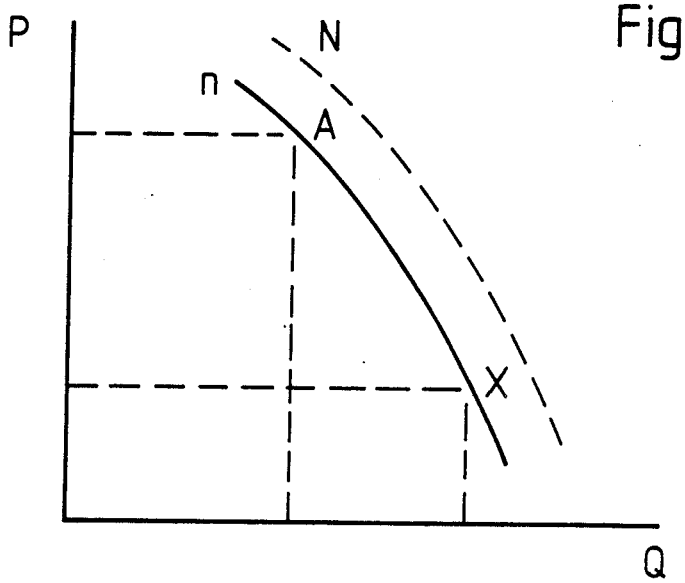
FIG. 3 is a diagram explaining the operation of the plant.

At the preset operating speed n of fan 24, the static pressure P at the fan outlet is related to the amount Q of conveyed air over the fan characteristic (FIG. 3). When the flow resistance of the plant is high (high static pressure at meter M), the fan 24 delivers a relatively small amount of air (e.g. operating level A). When the speed n remains unchanged but the resistance (static pressure) is greatly reduced, fan 24 conveys a much larger amount of air, e.g. operating level X.

This behaviour of fan 24 can be adapted to the conditions in the line, since a larger number of cards in the line means a reduced flow resistance (static pressure) but also requires an increased amount of air. It is therefore unnecessary for the required adjustment in the amount of air to be made by correspondingly displacing the fan characteristic (e.g. to increase the air flow, by correspondingly increasing the fan speed from n to N as shown by the chain line in FIG. 3). The "definition" of the line connected to the fan already determines the static pressure at the fan outlet and consequently the amount of air delivered by the fan.

In contrast to a plant with a special control system for the amount of conveyed air, the plant according to FIG. 2 and 3 has an additional advantage, in that it can adapt not only to the "definition" of the line but also to the instantaneous operating conditions in the line, provided that a significant change in operating conditions (e.g. failure of a card) results in a corresponding change in the flow resistance (static pressure) in the system. This is the case in a system according to European patent application No. 176668, since failure of a card blocks the flow of conveying air from duct 22 to the waste air system 34 (FIG. 1) and thus increases the flow resistance (static pressure) in the feed system.

There may therefore be no need for special means for controlling the amount of conveyed air. However, this does not apply to the amount of flock to be delivered by the feed machine 28. Suitable means for regulating the last-mentioned quantity during stop-go operation of the feed machine will now be described with reference to FIGS. 4–7.

Figure 4:
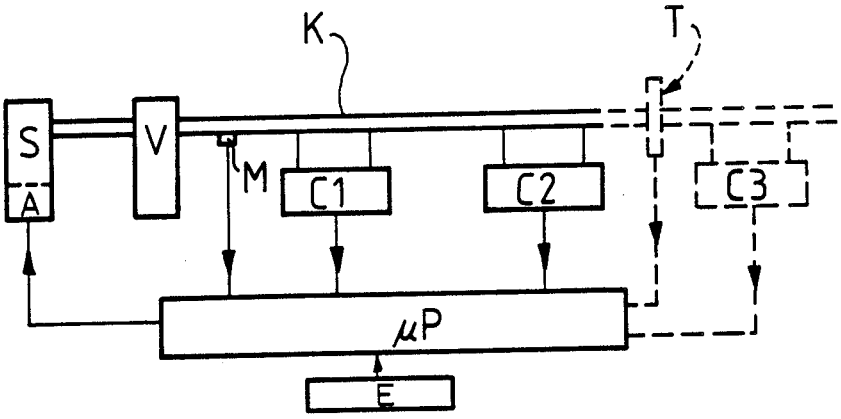
FIG. 4 is a diagram similar to FIG. 2 but with additional sensors and control elements.

FIG. 4 shows a line similar to that in FIG. 2 but greatly simplified, in order to clarify the explanation of the basic principles. Once these principles have been clearly set out, their application to more complicated plants, e.g. as in FIGS. 1 and 2, will also be clear.

The description will first concentrate on the plant shown in continuous lines in FIG. 4. This plant comprises a feed machine S, a fan V, a feed duct K, two cards C1 and C2 each having a filling chute (not shown), a microprocessor control system $\mu$P and a controllable drive A for the feed machine S. A meter M for measuring the static pressure is incorporated in duct K between fan V and the first card C1. It delivers an output signal to microprocessor uP. Each card C1, C2 delivers a signal to microprocessor uP in order to show whether the card is instantaneously in operation or not. The microprocessor control system uP delivers a control signal to the drive A of feed machine S.

Figure 5:
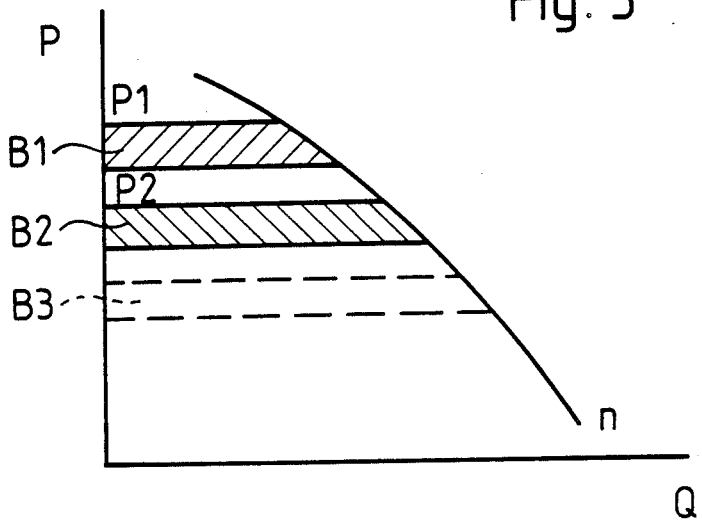
FIG. 5 is a diagram corresponding to FIG. 3, explaining the device in FIG. 4.

The fan drive (not shown) is not controllable by the system uP. During operation, the fan runs at a constant speed corresponding to a particular characteristic (FIG. 5).

The control system must co-operate with the other components so that the filling chute of each producing card remains "full" (within certain tolerances). As shown in the description of FIGS. 1 to 3, the static pressure in duct K represents the filling conditions at meter M. As also shown, however, a given value of the static pressure may have various "meanings" as regards the filling conditions in dependence on the operating conditions.

However, it is possible to provide a means e.g. in the control system to define two "working ranges" for the (static) "operating pressure" measurable by the meter M. The upper range B1 (FIG. 5) corresponds to operation of the line when only one of the two cards (C1 or C2) is in use. A second card (C2 or C1) is not producing, e.g. because of a failure (disturbance) during can changing, or for carrying out maintenance work, or simply because the production from one card is adequate for the moment.

The upper limit of pressure range B1 corresponds to the "chute full" state in the card still in operation (C1 or C2). The lower limit of the same range corresponds to the "refilling required" stage for the same card still in operation. As described in greater detail hereinafter, the control system uP is disposed so that it switches on the feed-machine drive A when the lower limit of range B is reached and switches it off when the upper level of range B1 is reached.

The lower operating range B2 corresponds to operation when both cards C1 and C2 are in use. The upper limit of range B2 corresponds to the "both chutes full" state. The lower limit of this range corresponds to the "refilling necessary" (of one or the other or both cards) state. Exactly as in the case of range B1, the microprocessor control system up is designed to switch off the feed machine when the upper limit of range B2 is reached and to switch the feed machine on when the lower limit is reached.

An important feature of this method of control is that the upper limit (static pressure P1) of the working range B1 is appreciably higher than the lower limit (static pressure P2) of the working range B2. In order to recognize the right times for switching off, therefore, the control system uP must have information about the number of cards instantaneously in operation. This information is received by the control system e.g. via diagrammatically indicated signal lines from each card.

The width of each working range B1, B2 is less dependent on the conveying system than on the signal system. It is advisable to incorporate some hysteresis in the signal system to avoid continually switching the feed drive on or off. Preferably the minimum acceptable hysteresis is chosen, and will be the same for the two working ranges B1 and B2 which are shown apart in FIG. 5. In practice, however, it does not matter if adjacent ranges overlap.

Switching-off points P1 and P2 have to be determined in individual cases depending on the structure of the plant and fed to the microprocessor, which can be done by a manual input unit E connected to the control system uP, or can be preprogrammed. The width of the various working ranges can also be communicated to the control system in the same manner. This information is stored in the control system for calling on request.

Figure 6:
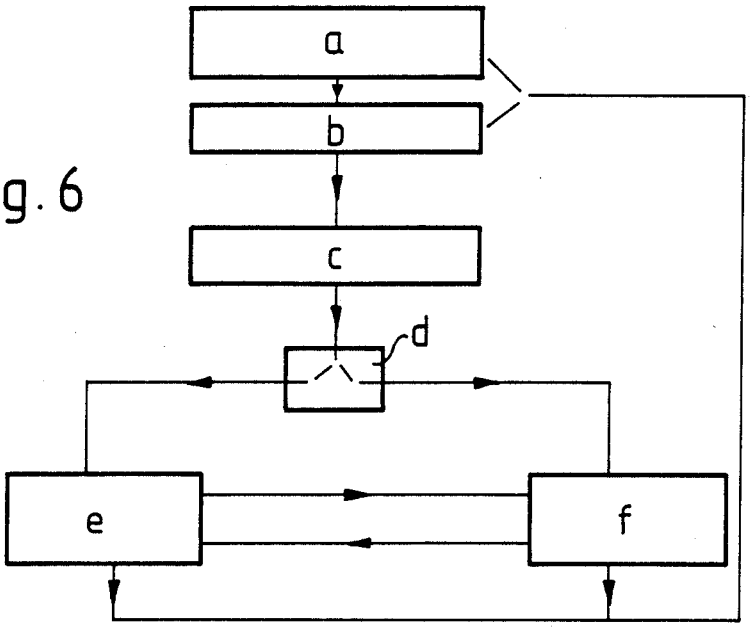
FIG. 6 is a flow diagram representing certain functions of the control system and FIG. 7 shows the input and output connections of a central control unit for a system as in FIG. 4.

FIG. 6 is a flow diagram of the procedure in the control system during normal operating. Box a indicates a standby state where no material is required because neither of the two cards is in operation (producing). Box b denotes a new state where at least one card is producing (material required). After determining the number of producing cards, the control program proceeds to box c, where the data are requested for the working range B1 or B2 in dependence on the number of producing cards.

Box d denotes a comparison between the signal received by meter M and the data for the instantaneous operative working range B 1 or B2. If the pressure Pi measured by meter M lies within or below the working range called on, the control system switches on the feed drive (box e). If the upper limit of the working range is reached, the control system switches the feed drive off (box f).

Conversely, if it is found during step d that P1 is already above the upper limit of the working range called on, the control system first proceeds to box f and then to box e when the lower limit of the range is reached. If there is no alteration to the number of cards to be fed, the control system will continue to move backwards and forwards between boxes e and f in order to switch the supply on and off accordingly.

If the number of cards for feeding changes, the control system first switches off the feed machine drive and goes back either to box a (standby) or to box d (determination of number of cards to be fed). The number of cards to be fed can be altered at any time; in the event e.g. of a change from one to two cards, the operating pressure Pi will already during the alteration be far above the new upper limit P2 and the control system accordingly first proceeds from box d to box f.

The control system uP only switches the feed drive A on and off; in this example it exerts no influence on the speed of the drive, i.e. on the production of the feed machine. During normal operation, the production is predetermined and kept constant, resulting in a constant quality (processing of fibers). The set production must be adequate for the maximum possible "demand" from the connected cards. Normally a certain "over-production" is preset, so that if all the connected cards produce at the maximum rate, there will be an efficient ratio between the inoperative and the operative time of the feed machine in stop-go operation, e.g. 90% operative to 10% inoperative time. If the number of producing cards decreases, the production of the feed machine remains the same as before (during the operative time) as already mentioned, but the operative/inoperative time ratio decreases.

It will now be clear that the control procedure described is not restricted to a single plant with only two cards. It does not seem necessary to describe the application of the principle to a line with more than two (any number of) cards. In the case of a non-adjustable line as previously assumed in conjunction with FIG. 4, the production of feed machine S can be fixed or can be permanently adjusted when the plant is installed. If however the number of cards allocated to a feed machine can be altered, e.g. as already described in connection with FIG. 1, it is not advisable permanently to adjust the production of feed machine S. Instead, the production should be adjusted to the number of cards allocated to the feed machine to obtain an optimum operative/inoperative time ratio for each proposed allocation.

Of course there are various possible methods of adapting the production of the feed machine to the number of cards allocated to it. The production can e.g. be adjusted manually on the machine, in which case the control system up will be used only for switching on and off.

Alternatively, the required adaptation can be made by the control system uP if it is given the required information. If for example the line contains a separator T, as shown by chain lines in FIG. 4, the separator can also be connected by a signal line to the control system uP so that the system is informed about the instantaneous "effective structure" of the line. In the example given, separator T shuts off the supply duct K between card C2 and a third card C3. If the separator T is made inoperative, card C3 can also be supplied with flocks by machine S via duct K. In that case, if all three connected cards are producing, the control system uP will set a third working range B3 (FIG. 5) for the operating pressure Pi.

In the simplest case, each card connected to the plant has the same production. The production of the feed machine to be set by the control system uP will then be a linear function of the number of cards allocated to this feed machine. If different cards have different productions, the production set for the feed machine will be a non-linear function of the number of allocated cards, but this can without difficulty be taken into consideration when programming the system uP.

The method of controlling the feed machine drive via the central control system uP can be adapted to the construction of the units. The central control can e.g. supply the feed machine via respective lines with two different signals, i.e. and on/off signal via one line and a signal representing the required speed via a second line. Alternatively the signals can be combined and sent via a single line, e.g. if the signal level during the one phase is adjusted to the required speed.

It should be clear that a single control system uP is sufficient for operating a plant as in FIG. 1. Under these circumstances, as already mentioned, there are various possible methods of informing the central control system of how the cards are allocated to the two feed machines 28 and 30. The allocation can e.g. be manually adjusted at the respective card and set therefrom via a signal connection to the control system. Preferably, however, adjustment of the plant by the operator is avoided as far as possible, i.e. the plant should be substantially automatically adjustable. An embodiment having this aim will now be described with reference to FIG. 7, on the basis of a plant according to FIG. 1 and U.S. Pat. No. 4,648,754 and U.S. patent application Ser. No. 138,835, filed on or about Dec. 28, 1987 and corresponding to European patent application No. 0176668.

Figure 7:
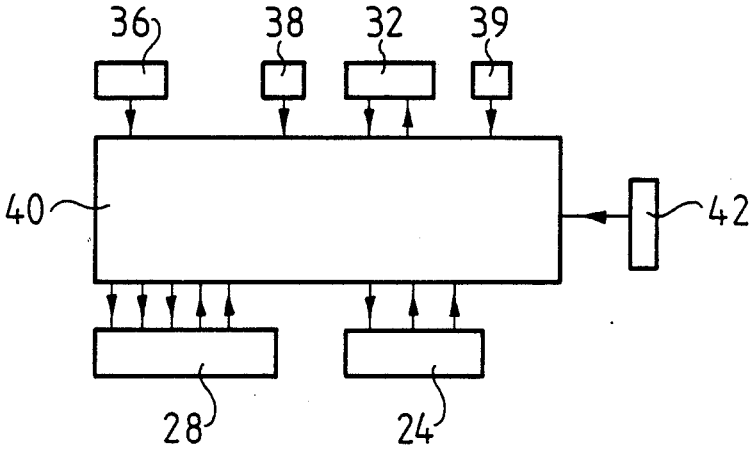

In FIG. 7, reference 40 denotes a diagrammatically indicated central control unit for the feed plant in FIG. 1. By way of example, the signal connections are shown between the central unit and some units on a single line in the plant, i.e. the line comprising feed machine 28 and fan 24. A pressure sensor 36 (for static pressure is incorporated in the duct portion between fan 24 and the first card of the line, and is also connected to central unit 40.

Each filling chute 32 (only one chute is shown in FIG. 7) is also connected by signal lines to the central unit. As in EPA No. 175056 (U.S. Pat. No. 4,648,754), each chute 32 is allocated two separating units, one unit being disposed in front of and the other unit being disposed behind the chute in the flock conveying direction. According to the invention, the adjustments of the various separating units are monitored in order to detect whether the unit is or is not blocking the feed duct for supplying flocks or conveying air. For example, each separating unit can be assigned a respective initiator for monitoring the instantaneous position of the main components of the separator unit. Each chute 32 is therefore associated with two monitoring sensors (initiators) 38, 39 as diagrammatically indicated in FIG. 7, which are also directly connected to a central unit 40 via respective signal lines.

By way of illustration, more than two signal lines are shown between feed machine 28 and unit 40. The two connections of importance to the plant convey respective signals from unit 40 to machine 28 (or to the drive thereof) in order (1) to determine the production of the feed machine and (2) to switch the machine on and off, as already described in connection with FIG. 4. The additional lines can convey various signals of state (e.g. standby, fault, operation) between the feed machine and the central unit.

The connections between fan 24 and unit 40 convey only signals of state or an on/off signal from unit 40 to fan 24. The speed of the fan cannot be controlled by the central unit 40, and during normal operation the fan 24 has to operate continuously whether flocks are conveyed or not.

The pressure sensor 36 supplies unit 40 with a signal representing the actual value of the operating pressure.

The signal can be an analog signal or a discrete digital signal in which case the continuously variable actual value of the operating pressure is converted by a sampling process into a sequence of digitally coded values.

As already mentioned, each sensor 38, 39 delivers a signal to central unit 40 representing the instantaneous state of the corresponding separator unit. By evaluating these signals, unit 40 is able to determine the instantaneous allocation of cards 20 (FIG. 1) to machines 28 and 30. The operator therefore only has to set the separator units manually in the states suitable for the desired arrangement of the total plant. The resulting allocation is used by the central unit 40 to determine the corresponding production of each feed machine 28, 30 and to inform the feed machines accordingly. To this end, however, the central unit also needs information about the production per card, which can be manually supplied by the operator via an input unit 42.

Unit 40 exchanges signals of state with each chute 32. The "chute in operation" signal from the chute to the central unit 40 is important in the present embodiment, because it is critical for determining the instantaneous effective working range (see FIG. 5) for the operating pressure and consequently for the feed-machine control. Since the filling chutes 32 are constructed as per European patent application 176668, this signal can be obtained by monitoring the position of the valve disposed between chute 32 and the exhaust air system 34 (FIG. 1).

If the valve is closed, i.e., the air path from the filling chute to the exhaust air system is blocked, it means that the corresponding card is switched off for some reason. As already described, this must result in a change in the operating-pressure setting in the central unit. If the valve is in an open position in order to enable conveying air to flow through the chute to the exhaust air system, this means that the corresponding card is producing, which must also be registered in the central unit in order to determine the appropriate pressure range.

The plant is not restricted to the combination comprising one filling chute according to European patent application No. 176668. The signals for determining the operating states of the cards can without difficulty be obtained from other components, e.g., from the card doffer drive. As already indicated in the preceding description, where the card and the chute are combined in an operating unit, the signal can be obtained either from the chute or from the card.

Unit 40 also needs information about the working range of operating pressure (FIG. 5) specific to the plant. This information can of course also be input via unit 42. Preferably, however, it is a pre-programmed in the central unit, when the working ranges can be "shifted" in common (in order to allow for the variations between different plants) by means of an adjustable "system constant". This constant is preferably not variable via the input unit 42 but by means of a specific adjusting element which can be set when the plant is installed and does not need to be subsequently reset unless the construction of the plant is altered.

MODIFICATIONS

The invention is not restricted to details of the embodiments described. More particularly it does not matter as far as the invention is concerned whether the amount of conveying air is automatically adjusted to a number of producing cards. If the amount of air is adjusted to the operating conditions by varying the speed of the fan, there may possibly be no corresponding change in static pressure in the feed duct (see shift of fan characteristic from n to N in FIG. 3). Even so, there is a recognizable corresponding change in other operating parameters, e.g. in the output of the fan by incorporation of suitable sensors (e.g. in the connection between the fan and a mains system, not shown); these alterations can be determined by the central control system and compared with a working range for this parameter depending on the number of producing cards. The feed machine can be switched on and off accordingly.

An important feature of the invention is a detectable change in a predetermined operating parameter corresponding to a change in the number of machines to be supplied. The change need not necessarily be brought about by the control means but can be inherent in the system, as described in connection with FIGS. 1 to 3. It has been found, e.g. in one of the Aerofeed U plants, that the operating pressure decreases from e.g. 650 Pascals to about 300 Pascals if the number of fed chutes (cards) in a line is increased from one to ten.

In the preferred variants, the pressure measured in the feed duct is used only for switching the feed machine on and off. For this purpose, it is not absolutely necessary for the central control system to be given information about the instantaneous operating pressure. A suitable meter can e.g. itself determine whether the operating pressure is within preset limits or not. In that case, however, the meter must itself be equipped with a suitable adjustable evaluating means, and the adjustment must be made by the control system in accordance with the number of machines to be fed. The on/off signal can then be sent directly from the meter to the feed machine (without passing through the central control system).

As already clearly described in DOS No. 442 942, the amount of air conveyed must in all cases be adapted to a change in the construction of the total plant. The amount of air therefore is itself an operating parameter which can be used to determine the corresponding adjustment required in the flock feed. It is more difficult to measure the amount of air than the static pressure, and accordingly the latter measurement is preferred when possible. If however the static pressure cannot be used to give a clear signal for determining the flock production, it is possible to fall back on measuring the quantity of air. A suitable device for this purpose is indicated by way of example in FIG. 6 of DOS No. 3 442 942. As another possibility the dynamic pressure (instead of the static pressure) could be chosen as the operating parameter.

The aforementioned separating units need not necessarily be hand-operated, but can be automatically adjusted. The production of the cards (for determining the set maximum production Pm of the feed machine) can also be transmitted automatically to the control system.

To summarize, in the example given the flock feed (the effective production during stop-go operation of the feed machine) is regulated by determining the filling conditions in the chutes. The filling conditions are determined not directly but via their effects on a given parameter of the conveying system, e.g. on the static pressure at the fan outlet. The relation between this parameter and the filling conditions is a function of the number of producing (i.e. fibre-consuming) cards. The control characteristic is adapted to the number of fibre-consuming cards accordingly.

This invention is not restricted to the control of flock feed (during stop-go operation). It can also be used for controlling the instantaneous production during continuous operation. In general, the invention is of use when the flock feed is controlled via changes in a given operating parameter and the parameter is itself dependent on the number of fibre-consuming machines.

What is claimed is:

1. A fiber processing plant comprising a pneumatic flock feed system for conveying a flow of flock, said feed system including a flock supply means for supplying flock into said system at a preselected constant rate;

a plurality of fiber processing machines connected to said system for receiving flock therefrom; and control means connected to said flock supply means to switch said flock supply means on and off for controlling the overall amount of flocks conveyed in said system in a stop-go operation with said preselected rate, said control means being adjustable in dependence on the number of fiber processing machines in operation.

2. A fiber processing plant as set forth in claim 1 wherein said control means is responsive to an operating parameter of said feed system.

3. A fiber processing plant as set forth in claim 2 wherein said operating parameter is automatically adapted to the number of fiber processing machines in operation.

4. A fiber processing plant as set forth in claim 2 further comprising means for determining a set range for said operating parameter, said latter means being adjustable in dependence on the number of fiber producing machines in operation.

5. A fiber processing plant as set forth in claim 2 wherein said operating parameter is the static pressure at a measuring place in said feed system.

6. A fiber processing plant comprising a pneumatic flock feed system including a flock supply means for supplying flock at a preselected constant rate, a feed duct for conveying flock and a fan for blowing flock from said supply means into said feed duct;

a plurality of fiber processing machines connected to said feed duct for receiving flock therefrom; and control means connected to said supply means to switch said supply means on and off for controlling the amount of flock supplied to said fan from said supply means in dependence on the number of said fiber processing machines in operation.

7. A fiber processing plant as set forth in claim 6 wherein said control means is connected to each fiber processing machine to receive a signal therefrom indicative of the operation of said machine, said control means being responsive to said signals to adjust said supply means to vary the supply of flocks therefrom proportional to the number of said machines in operation.

8. A fiber processing plant as set forth in claim 6 which further comprises a meter in said feed duct between said fan and a first of said fiber processing machines for sensing the static pressure therein, said meter being connected to said control means to deliver a signal thereto corresponding to the sensed static pressure in said feed duct, said control means being responsive to said signal to switch said supply means on and off.

9. A fiber processing plant as set forth in claim 8 wherein said control means is connected to each fiber processing machine to receive a signal therefrom indicative of the operation of said machine, said control means being responsive to said signals to adjust said supply means to vary the supply of flock therefrom.

10. A fiber processing plant comprising a pneumatic flock feed system including a flock supply means for supplying flock in a stop-go operation at a preselected constant rate, a feed duct for conveying flock and a fan for blowing flock from said supply means into said feed duct;

a plurality of fiber processing machines connected to said feed duct for receiving flock therefrom; and a meter in said feed duct between said fan and a first of said fiber processing machines for sensing the static pressure therein, said meter being connected to said supply means to deliver a signal thereto corresponding to the sensed static pressure to switch said supply means on and off.

11. A fiber processing plant comprising a pneumatic flock feed system including a flock supply means for supplying flock in a stop-go operation at a constant rate, a feed duct for conveying flock and a fan for blowing flock from said supply means into said feed duct;

a plurality of fiber processing machines connected to said feed duct for receiving flock therefrom; and means for monitoring an operating parameter of said feed system as a function of the number of said fiber processing machines in operation to generate a corresponding control signal, said means being connected to said supply means to actuate said supply means in response to said control signal.

12. A fiber processing plant as set forth in claim 11 wherein said means for monitoring includes a meter in said feed duct between said fan and a first of said fiber processing machines for sensing the static pressure therein, said meter being connected to said supply means to deliver a signal thereto corresponding to the sensed static pressure to switch said supply means on and off.

13. A fiber processing plant as set forth in claim 12 wherein said means for monitoring includes a control means connected to said meter to receive said control signal and to each fiber processing machine to receive a signal therefrom indicative of the operation of said machine, said control means being responsive to said signals to adjust said supply means to vary the supply of flock therefrom.

14. A fiber processing plant comprising a pneumatic flock feed system including a flock supply means for supplying flocks in a stop-go operation at a constant rate, a feed duct for conveying flocks and a fan for blowing flocks from said supply means into said feed duct;

a plurality of fiber processing machines connected to said feed duct for receiving flocks therefrom;

means for determining the number of processing machines to be supplied;

means for determining a set value for an operating parameter in dependence on the number of machines to be supplied;

a meter for responding to said operating parameter to deliver an actual value signal; and an actuator for comparing said actual value signal with said set value to actuate said supply means in response to a preset deviation therebetween.

15. A fiber processing plant as set forth in claim 14 wherein said parameter is the static pressure in said feed duct between said fan and a first fiber processing machine.

16. A fiber processing plant as set forth in claim 15 wherein said actuator switches said supply means on and off in response to a deviation between said actual value signal and said set value.

17. A fiber processing plant as set forth in claim 15 wherein said actuator adjusts said supply means in response to a deviation between said actual value signal and said set value.

18. A fiber processing plant comprising a pneumatic flock feed system including a flock supply means for supplying flock, a feed duct for conveying flock and a fan for blowing flock from said supply means into said feed duct;

at least two fiber processing machines connected to said feed duct for receiving flock therefrom;

a meter in said feed duct between said fan and a first of said fiber processing machine to sense the static pressure and to deliver an actual value signal in response thereto;

means for defining a pair of working ranges of static pressure to be sensed by said meter, one of said ranges corresponding to operation of only one of said processing machines and the other of said ranges corresponding to operation of both of said processing machines; and a control system responsive to said means and connected to said meter to receive said actual valve signal and connected to said supply means to switch said supply means on and off in response to said actual signal falling respectively below and above each said range.

19. A method for controlling a pneumatic fiber processing plant comprising the steps of supplying flock in a stop-go operation at a preselected constant rate to a feed duct of a feed system connected in common to a plurality of fiber processing machines;

monitoring an operating parameter of the feed system as a function of the number of processing machines in operation to generate a corresponding control signal; and adjusting the feed system in dependence on said control signal.

20. A method as set forth in claim 19 wherein the feed system has a supply means for supplying flock and a fan between the supply means and the feed duct and wherein the fan is driven continuously with a predetermined rotation per minute during operation of the plant.

21. A method as set forth in claim 20 wherein the supply means is switched on and off in response to said control signal.

22. A method as set forth in claim 20 wherein the supply means is adjusted to vary the supply of flock therefrom in accordance and proportional to the number of processing machines in operation.

23. A fiber processing plant comprising a pneumatic flock feed system for conveying a flow of flocks;

a plurality of fiber processing machines connected to said system for receiving flock therefrom; and control means for controlling the amount of flock conveyed in said system in response to an operating parameter of said system, said control means having first means to measure said operating parameter of said feed system and generate a measured signal in response thereto and second means to define a plurality of working ranges for said operating parameter, each said working range corresponding to a predetermined number of said processing machines being in operation whereby said control means controls said feed system in dependence on said measured signal being in a given one of said working ranges corresponding to the number of processing machines in operation.

24. A fiber processing plant as set forth in claim 23 wherein said control means is connected to said feed system to switch said feed system on and off in dependence on said measured operating parameter.

* * * * *

UNITED STATES PATENT AND TRADEMARK OFFICE

CERTIFICATE OF CORRECTION

PATENT NO. : 4,940,367

DATED : July 10, 1990

INVENTOR(S) : Christoph Staheli, et al

It is certified that error appears in the above-identified patent and that said Letters Patent is hereby corrected as shown below:

On the title page item [54] in the title, and column 1, line 3, "CARTING" should be --CARDING--.

Column 1, line 4 "carting" should be --carding--.
Column 2, line 8 "fed" should be --feed--.
Column 5, line 41 "speed" should be --speed n--.
Column 6, line 9 "up" should be --uP--.
Column 7, line 44 "up" should be uP--.
Column 8, line 5 "and" should be --an--.

Signed and Sealed this

Third Day of March, 1992

*Attest:*

HARRY F. MANBECK, JR.

*Attesting Officer*

*Commissioner of Patents and Trademarks*